United States Patent [19]

Cole

[11] 4,331,197

[45] May 25, 1982

[54] MICROWAVE CORE PROCESS

[75] Inventor: Gerald S. Cole, Southfield, Mich.

[73] Assignee: Ford Motor Company, Dearborn, Mich.

[21] Appl. No.: 54,215

[22] Filed: Jul. 2, 1979

[51] Int. Cl.[3] ..... B22C 1/18

[52] U.S. Cl. ..... 164/522; 164/525; 164/528; 164/250.1

[58] Field of Search ..... 164/21, 41, 48, 49, 164/250, 43, 15, 5, 522, 525, 528, 250.1, 511; 264/25

[56] References Cited

U.S. PATENT DOCUMENTS 3,692,085 9/1972 Brown et al. ..... 164/48 X

FOREIGN PATENT DOCUMENTS 47-21327 10/1972 Japan ..... 164/250
51-35621 3/1976 Japan ..... 164/41
1171963 11/1969 United Kingdom ..... 164/41

*Primary Examiner*—Gus T. Hampilos
*Attorney, Agent, or Firm*—Joseph W. Malleck; Olin B. Johnson

[57] ABSTRACT

A rapid method for dehydrating a water-sand mixture containing sodium or potassium silicate to produce a strongly bonded sand core is disclosed. The silicate is mixed in a water/silicate ratio of 1.45–3.22:1 and is limited to 0.25–3% of the weight of the mixture. The core box is semi-foraminous and partially transparent to micro-wave energy whereby generated vapor is reduced due to the heated inner surface of the core box (some degree of lossiness) and due to some escape through limited core-box openings. The controlled supersaturated environment about the core serves to prevent micro-porosity and surface defects when controlled micro-wave energy is used to heat cure the mixture. To promote resistance to humidity after curing, the mixture may contain 0.5% zinc oxide, chromic oxide, or aminoaldehyde.

12 Claims, 12 Drawing Figures

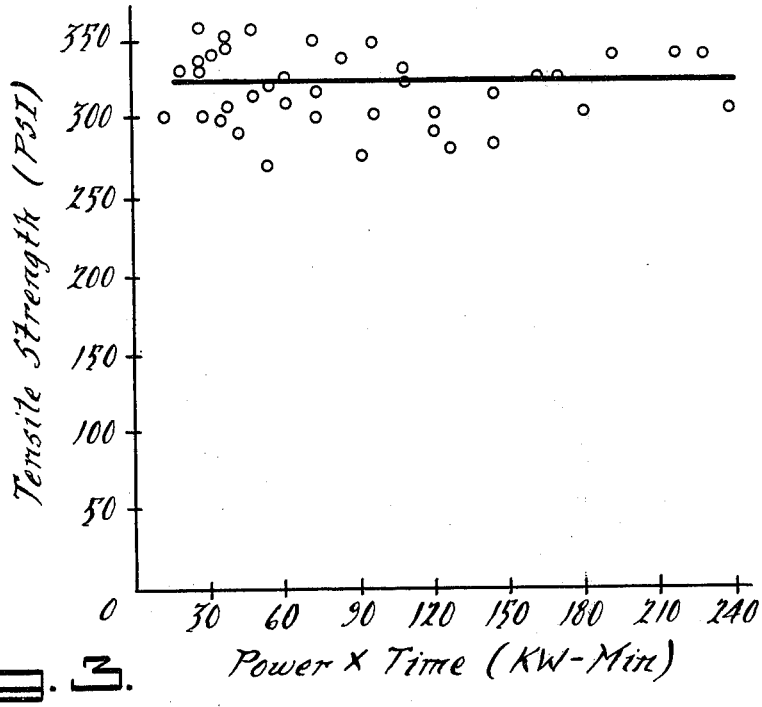
FIG. 3.
FIG. 4.
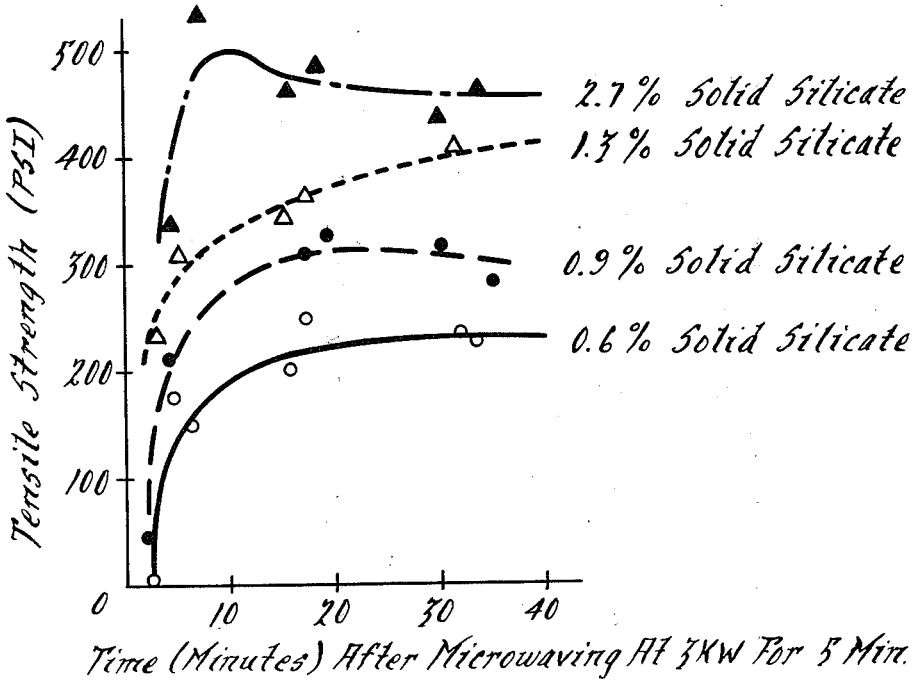

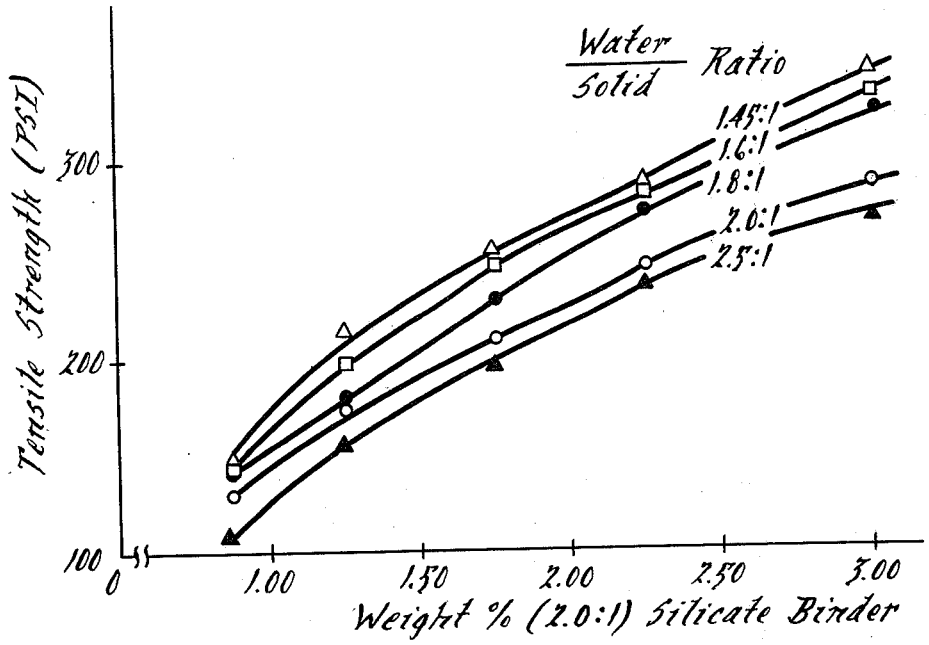
FIG. 7.
FIG. 8.
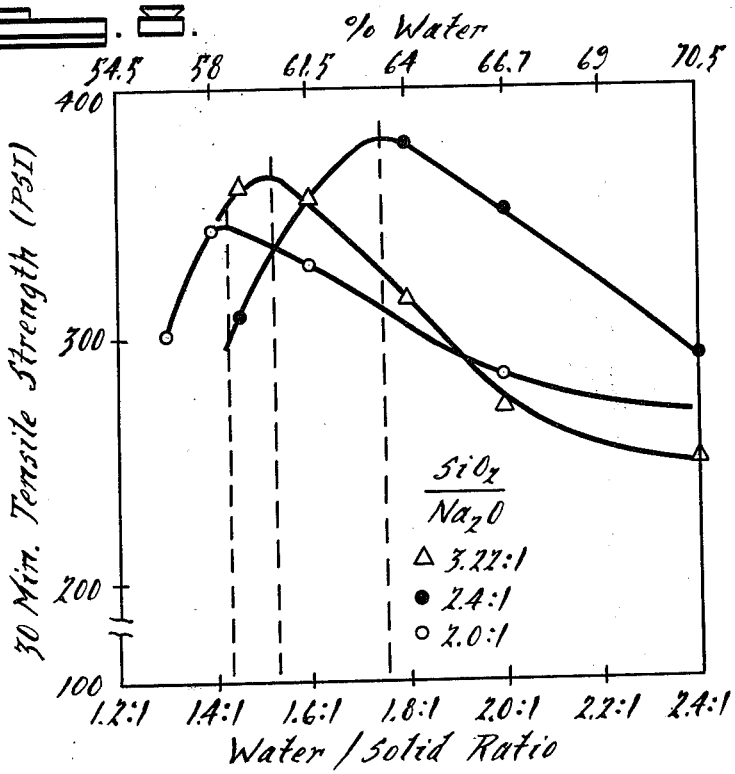

MICROWAVE CORE PROCESS

BACKGROUND OF THE INVENTION

Core making generally involves mixing sand with a binder that sets by chemical action (cold cure method) or by heat (hot-box method). The cold cure processes have proved commercially successful because of their speed and core strength achievable without the need for thermal energy. However, the noxious and contaminating characteristics of the curing gas for cold cure resins have been a considerable draw back. With respect to the hot box type, one process stands out in this regard because the chemicals employed are relatively free from noxious odors and the chemical system is responsive to thermal energy which can be generated by microwaves. This hot box system employs a water soluble inorganic binder, such as sodium and potassium silicates, which while it can be cured either by $CO_2$ gas or esters, it can also be cured by heat.

The concept of using microwave energy to cure sand mixtures for core making is known. However, in spite of the general state of the art with respect to microwave technology, several problems remain to be solved with respect to making better quality cores which can be employed in aluminum semi-permanent molding. These problems fall into basically two categories, (1) the rapidity of heating with microwave energy causes uncontrolled rapid expansion of gases within the sand core leading to cracking, (2) uneven heating and curing of the core sand mixture may result from unusual core configurations and from reliance solely on molecular friction of the resin to do the heat curing, and (3) microwaved sand cores have an unusual tendency to absorb moisture during storage which eventually destroys their desired strength characteristics, and (4) lack of a uniform gradient of curing to insure proper strength and at the same time provide easy shakeout of the sand grains. Accordingly, it is important that there be improved molecular polar heating of the water-resin solution within the sand mixture without experiencing extremely rapid vapor generation and with improved heat transfer from the surrounding core box to insure a uniformity of curing gradient, and that there be some mechanism to reduce hygroscopic tendencies of the core.

SUMMARY OF THE INVENTION

A primary object of this invention is to provide an improved method for dehydrating a sand mixture containing a water soluble inorganic resin, the method being quicker, easier and lower in cost than related prior art methods.

Another method aspect is to make cores for metal casting, the method employing materials which are non-toxic and substantially eliminate odor emissions and controls therefor. Still another method aspect is to make cores useful for semi-permanent mold casting of aluminum, the method having an increased rate of productivity while at the same time improved core quality.

Yet still another method aspect is to employ materials that permit the sand to be easily recycled while at the same time are easily removed subsequent to casting.

Another object of this invention is to provide a method of core making which produces a core having a reduced hygroscopic characteristic during long storage conditions compared to cores made by related methods utilized today.

Features pursuant to the above objects comprise: (a) employing a sand mixture containing less than 1% of a water soluble inorganic binder or resin, particularly sodium or potassium silicate, (b) adding the sodium or potassium silicate in the solid form permitting reconstitution at a precise moment and permitting a greater tolerance or range for water when so reconstituted without affecting strength, (c) adding about 0.5% (based on the quantity of sand) of an additive effective to improve shake out characteristics, the additive being selected from the group consisting of zinc oxide, chrome oxide, and aminoaldehyde, (d) employing a core box constructed of plastic and having filler material impregnated therein, the filler material consisting of glass, ceramics, or fibers, to obtain a desired degree of lossiness (partial transparency) to microwave energy, (e) the construction of a core box which is reuseable, low in cost so that it is discardable, and has a high degree of imprint definition so as to provide higher quality core configurations, and (f) carrying out microwave dehydration of the sand cores in a moist environment to improve the core surface character and increase resistance to humidity particularly with potassium silicate.

SUMMARY OF THE DRAWINGS

FIG. 3 is a graphical illustration of tensile strength (psi) versus power level x time (KW-MIN);

FIG. 4 is a graphical illustration of tensile strength versus time after microwaving for different silicate additions;

FIG. 7 is a graphical illustration of tensile strength versus percent silicate binder;

FIG. 8 is a graphical illustration of tensile strength versus water/solid ratio and percent water with different $SiO_2/Na_2O$ ratios;

Table I is a listing of particle size distribution for different sands used in certain samples.

Table II is a listing of data for tensile strength and shake out time for sand mixtures having different additives.

DETAILED DESCRIPTION

It has been known for some time that cores and molds, acceptable for metal casting applications, could be obtained by curing sodium silicate bonded sand in a conventionally heated oven. Within the last 10 years, certain isolated suggestions have been made in the art that microwave heating could be used to supply the necessary thermal energy for curing. These instances comprised laboratory or batch applications because large scale industrial microwave power systems were not available until relatively recent. These initial efforts to employ microwave energy for core curing under certain circumstances demonstrated feasibility, but did not give consistently good results so necessary for commercial application. The microwave energy expanded the gas forming elements so rapidly within the core that the gaseous products produced cracking and resulting poor quality. The core box design was principally constructed as a mechanism to permit microwave energy to pass totally therethrough; any control of the microwave energy was internally, if at all, within the core material or core cavity. Unfortunately, there occurred irregularities in the degree of curing because of the core configuration and the complete removal of the core box as an element of heat transfer.

NATURE OF MICROWAVE HEATING

Microwave heating or curing works when an electromagnetic wave is propagated in a heatable dielectric material, its energy being converted to heat. To understand this more fully, the molecular properties of dielectric materials must be examined. Water is the major dielectric material in the core making operation that is heated by microwave energy. In the case of this particular invention, the dielectric is more accurately a sodium silicate-water solution. The water molecules consist of hydrogen and oxygen atoms arranged so that each molecule is electrically neutral. Because of this arrangement, however, the electrical charges within the molecule have a dipole moment and are said to be polar. Different molecules have different degrees of polarity.

An electric field exerts a twisting force on a polar molecule that attempts to align the molecule with the field. When the direction of the field is reversed, the molecule attempts to reverse its orientation. However, in doing so, frictional forces created by the molecules rubbing together have to be overcome. Energy is thereby dissipated as heat. Friction generates heat and the dielectric becomes hot. Electrical energy that should be stored in the dielectric material is in part lost as heat, often called dielectric lossiness.

Figure 1:
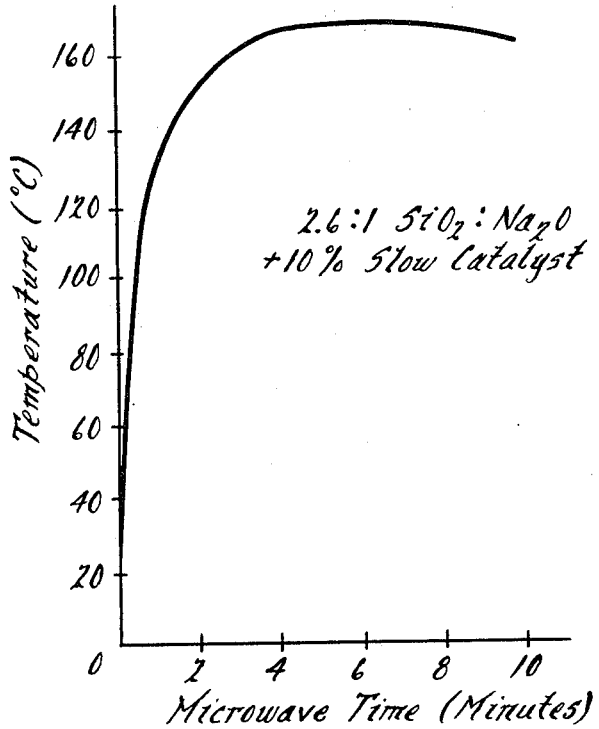
FIG. 1 is a graphical illustration plotting temperature against exposure to microwave energy, illustrating the temperature rise observed upon heating a sodium silicate sand mixture in a microwave oven.

During 2450 $MH_Z$ reversals (which is a typical operating frequency for conventional microwave ovens), microwave energy couples with available polar molecules so that molecular friction will produce internal heating of the dielectric. Sodium silicate-water solutions are particularly dielectrically active or lossy in this regard and heat up quickly when exposed to a microwave field. The typical effect is shown in FIG. 1. Here, a 2.6:1 ratio silica; soda ($SiO_2$:$Na_2O$) was added at a 1.5 weight percent to pure silica sand with a small addition of 10 weight percent catalyst (based on the resin content) which is typical for ester-cured silicates. It was then placed in a microwave oven for varying times at 3 kilowatts. As shown in this figure, there is a rapid temperature rise of several hundred degrees (°C.) per minute initially, and then after 2 minutes a more gradual increase until a final temperature near 175° C. has been attained. The process is not sensitive to temperature but rather a function of imparted energy and time.

Although other materials can be heated by microwave energy and form heatable dielectrics, only the water soluble inorganic systems have been found suitable for the present invention in making high quality cores. This is partly because of the inability to control the microwave heating of the dielectric in such other materials. The internal friction heat of the silicate-water solution produces the hardening and bonding reaction, the water evaporating from the resin.

Strength

The effect of microwave heating on the strength property of silicate-bonded sand composites is shown in FIG. 4 for a first series of samples. A 2.0:1 silica:soda silicate at varying concentrations from 0.6 to 2.7 weight percent solid silicate, was mixed with sand and subjected to microwave energy for five minutes at 3 kw. The dogbone tensile strength of samples were compared, a dogbone being a double figure eight shape which is 25.4 mm. (1 inch) thick, having a 645 $mm^2$ (1 $inch^2$) cross section at the junction. The dogbone samples were tested in tension for different times ranging from 3–4 minutes up to 24 hours afterwards. The observed strengthening effects were typical of all silicate-sand composites. There is a rapid rise in strength after the first several minutes followed by more gradual strengthening up to about 20 minutes after microwaving. The duration of the rapid rise depends on resin concentration and can be five minutes for the lower silicate percentages and as fast as three minutes for the higher ones. The maximum strength attained depends upon the resin content, such as 3450 kPa (500 psi) at the 2.7 level and 1500 kPa (215 psi) at the 0.6 percent concentration.

It is important to note that the sodium silicates are usually added to sand in concentrations exceeding 3% when either ester-curing or $CO_2$ gas-curing is employed as the strengthening or bonding promoting agents. With the present microwave curing invention, a much lower concentration can be used, preferrably in the range of 0.5–1%, but operationally 0.25–3%.

In another set of samples, three different silica sands were used: Wedron 5010, Lake Michigan sharp and Arkansas sharp each having a screen or particle distribution as shown in Table I. Liquid sodium silicate was used at the 2.0:1, 2.4:1, 2.88:1, and 3.22:1 silica-soda ratios. Two solid silicates were also employed, 2.0:1 and 3.22:1 class. With these latter materials different proportions of water:solid solutions were prepared and the core properties evaluated as a function of the water content, as well as the fraction of solid silicate present. It has been found that the solid silicates provides a distinct advantage in that when reconstituted with water, the tolerance or range of water can be greater (See FIG. 6) without affecting strength. More than twice the normal amount of water can be added without affecting strength significantly. Thus delaying dissolution by use of a solid additive permits the process to be more forgiving. This may be carried out by maintaining a supply of sand and silicate separate from a supply of water and sand; the two supply sources are then brought together just before blowing into a core box by a suitable mixing device.

TABLE I

| % Retained | L. Michigan | Arkansas | Wedron 5010 |
|---|---|---|---|
| #20 | 0 | 0 | 0 |
| #30 | 0.1 | 0 | 0 |
| #40 | 4 | 2.2 | 1 |
| #50 | 34 | 19.3 | 10 |
| #70 | 49 | 26.6 | 39 |
| #100 | 11.2 | 31.8 | 38 |
| #140 | 0.5 | 16 | 9 |
| #200 | 0.1 | 2.9 | 2 |
| #270 | — | 0.2 | — |
| PAN | 0.1 | 0.2 | — |
| AFS No. | 48 | 65.5 | 65 |
| % $SiO_2$ | 96 | 96 | 99.9 |

Sodium silicates are produced by melting sodium carbonate with silica, ($SiO_2$), at silica:soda ($SiO_2$:$Na_2O$) ratios varying from 1:1 to 3.75:1 adjustable by adding lime (NaOH) to the molten material. The molten glass is then quenched and dissolved in water. While most silicates used in foundry are purchased in the liquid form, solid hydrous products, produced by flash evaporation are also available.

With the second set of samples, 4 kg (10 lbs.) of sand, appropriate amounts of silicate, water and additives were thoroughly mixed in a mixer for two minutes. Dogbones were prepared by carefully hand tucking the sand mixture into a 12 gang aluminum dogbone core box. Twelve specimens were then removed from the core box, placed on a transite plate and then inserted, uncovered into a Raytheon microwave oven. Unless specifically noted, all curing took place at 5 kw oven power for three minutes. Immediately after completion of the curing cycle, the dogbones were removed and tested for tensile strength. Since tensile strength increases with time after microwaving, several time-strength relationships were measured. But in general, the strengths reported here were measured 30 minutes after completion of the microwave cure.

Figure 2:
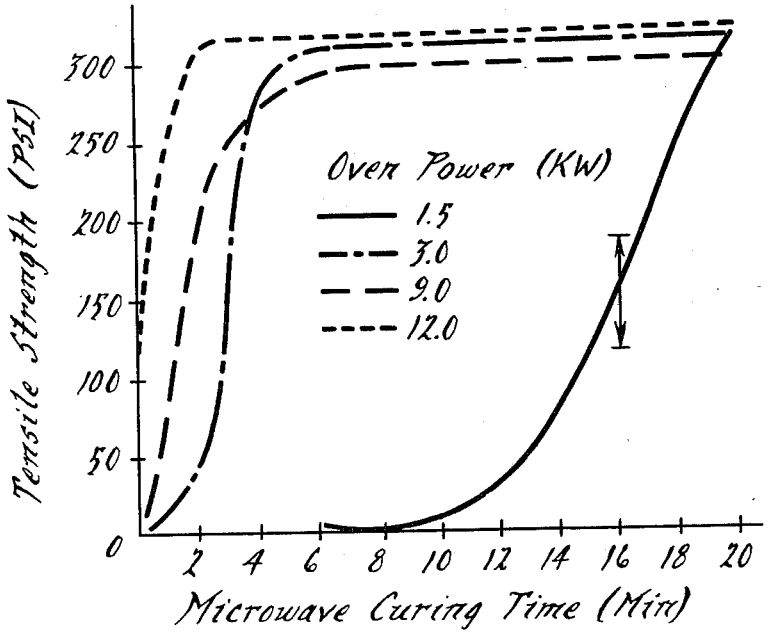
FIG. 2 is a graphical illustration of the strength of sand cores produced in accordance with this invention versus time; tensile strength is presented as a function of time after microwaving for a fixed period of time at a fixed energy level.

The effect of microwave energy is shown in FIG. 2. A 2.0:1 silica:soda ratio, 1.45:1 water/solids fraction, was formulated from 0.9% solid to give a silicate solution concentration of 3% based on the weight of the sand. At low over power (1.5 kw) between 18 and 20 minutes was required for the samples to attain maximum strength. At higher oven power the time required to reach maximum strength was shorter: thus with 3 kw, three to four minutes was needed while at 12 kw only one minute was necessary.

The data can be combined into one curve of tensile strength vs. kw per minute as shown in FIG. 3. It can be seen from FIG. 3 that the tensile strength is reasonably independent of power x time as long as it exceeds 15 kw min. For this reason 3 kw power for five minutes of curing was used as a standard throughout the investigation. It was thus observed that core strength depends on evaporating water, leaving a silicate film which becomes continually more viscous and rigid until it can support a load.

Figure 5:
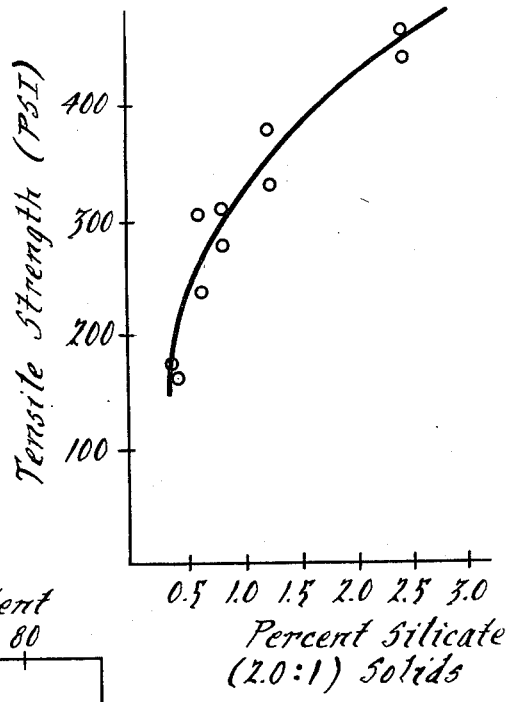
FIG. 5 is a graphical illustration of tensile strength versus water/solid ratio and percent water with the sand mixture containing different silicate amounts.

An important aspect of the microwave hardening process is that the buildup of strength to a maximum value is not completed during the microwave operation but continues afterwards and stabilizes after about 20 minutes. This is shown in FIG. 4 for four different 2.0:1 ratio silicate concentrations. As the solid silicate concentration increases, the tensile strength also increases and in an essentially exponential form as displayed in FIG. 5. Almost 450 psi (3100 kPa) is obtainable at the 3% level. These solid silicates can be considered identical to liquid formulations; for example a conventional 3 weight percent liquid silicate would have a solid content of 1.3%. The strength of these microwave cured samples considerably exceeds the more conventional process which use either $CO_2$ or esters to polymerize and harden the silicate.

Effect of Water on Core Strength

Solid silicates can be dissolved in water in one of two ways, either by adding the solid to water and allowing time for complete dissolution or by adding the water to the previously blended solid and sand. The latter approach was originally attempted, since there were certain processing advantages, but complete dissolution was rarely achieved with the 3.22:1 ratio material. As a result of this incomplete dissolution, the cores did not obtain their potential strength.

Figure 6:
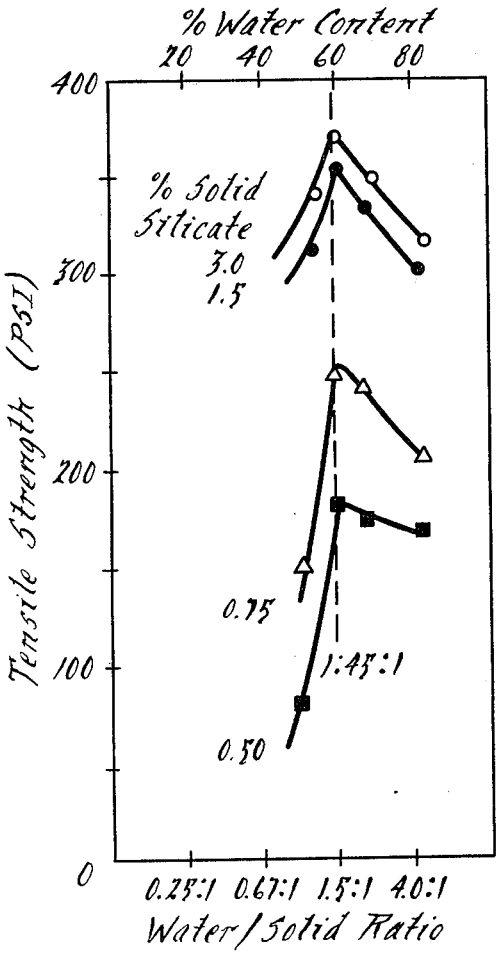
FIG. 6 is a graphical illustration of tensile strength versus percent silicate solids.

The effects of water content on reconstituted silicate solutions is presented in FIG. 6 for one sodium silicate (2.0:1) ratio. As the amount of water increases (water/solid ratio increasing), the core increases in strength until a specific ratio of 1.45:1 is reached (corresponding to 59% water and 41% solid). Additional water addition produces a slightly weaker core. When the water/solid ratio is too low (not enough water is present) the solution viscosity is high and mixing is more difficult. However, the more important effect is that water is taken out of solution by the sand during mixing and a continuous, rigid $Na_2SiO_3$ film cannot form. That is, when the correct amount of "temper" water has not been added, the core is friable and weak. At water contents above 59% (1.45:1 water:solid ratio) the core becomes slightly weaker since the 15 kw. min. (5 min.-3 kw) microwave heating cycle is too small to evaporate all the water. This effect is further demonstrated in FIG. 7. Here five different water:solid contents were prepared in varying solid silicate concentrations. Increasing the amount of water from 59% to 71% decreases the core strength by 50 psi. The critical water/solid ratio or critical water temper level varied with the silica:soda ratio of the silicate. This is shown in FIG. 8 for three ratios varying from 2.0 to 3.22:1. The 2.4:1 ratio sample requires the most water and also has the highest $SiO_2$ content (33.2%) while the sample that required the least water, the 2.0:1 ratio, had the lowest $SiO_2$ content (29.4%).

Effects of Humidity and Additives

Figure 9:
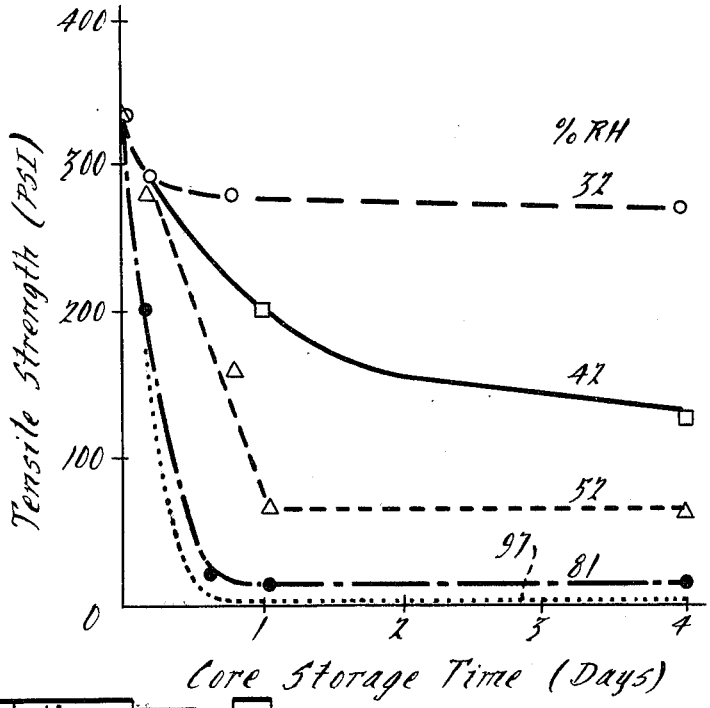
FIG. 9 is a graphical illustration of tensile strength versus core storage time (days)
Figure 10:
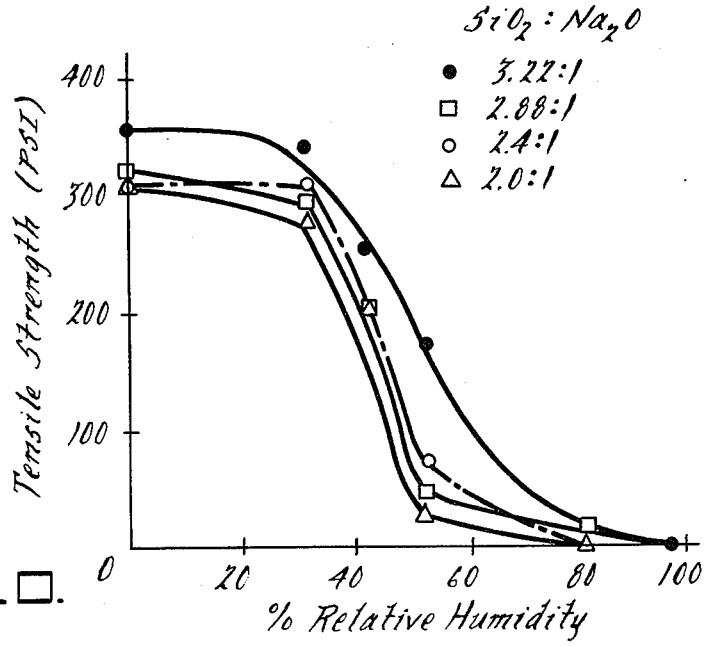
FIG. 10 is a graphical illustration of tensile strength versus percent relative humidity with different $SiO_2/Na_2O$ ratios.

A major characteristic of sodium and potassium silicate-bonded sand is the change in bond strength as a function of humidity. With $CO_2$ gas-cured systems, both low and high humidity environments have been shown to cause a reduction in the bond strength. In the former case, water is lost over a period of time and the sand composite becomes very fragile. In the latter case, the essential hygroscopy of the material produces a water pick-up and the composite can essentially disintegrate. To test the effect of relative humidity and temperature upon core strength, the cores were maintained in different relative humidity chambers before tensile testing. FIG. 9 depicts the data which was generated on hand rammed dogbones at 2.88:1 ratio silicates. It can be seen that even at 42% relative humidity there is considerable strength degradation, but at 80% and higher, such as 90%, the cores essentially fell apart. This occurs also with silicates of different silica:soda ratios, as shown in FIG. 10. This is particularly unexpected with potassium silicate since the prior art literature indicates that potassium silicate should be very hygroscopic even at lower humidities. It was found that when potassium silicate is used in a solid form, it is even more reactive. However, even without anti-hygroscopic additives, the resistance to humidity is improved by the processing technique. This may be explained by the fact that microwave heating is carried out with a moist environment about the sand body. The core box is only slightly foraminous controlling the release of vapor; the remaining vapor creates a moist environment to improve the surface character of the core. The core will have less microporosity and certainly less cracks. Evaporation is a violent action which is lessened by the supersaturated core environment.

Figure 11:
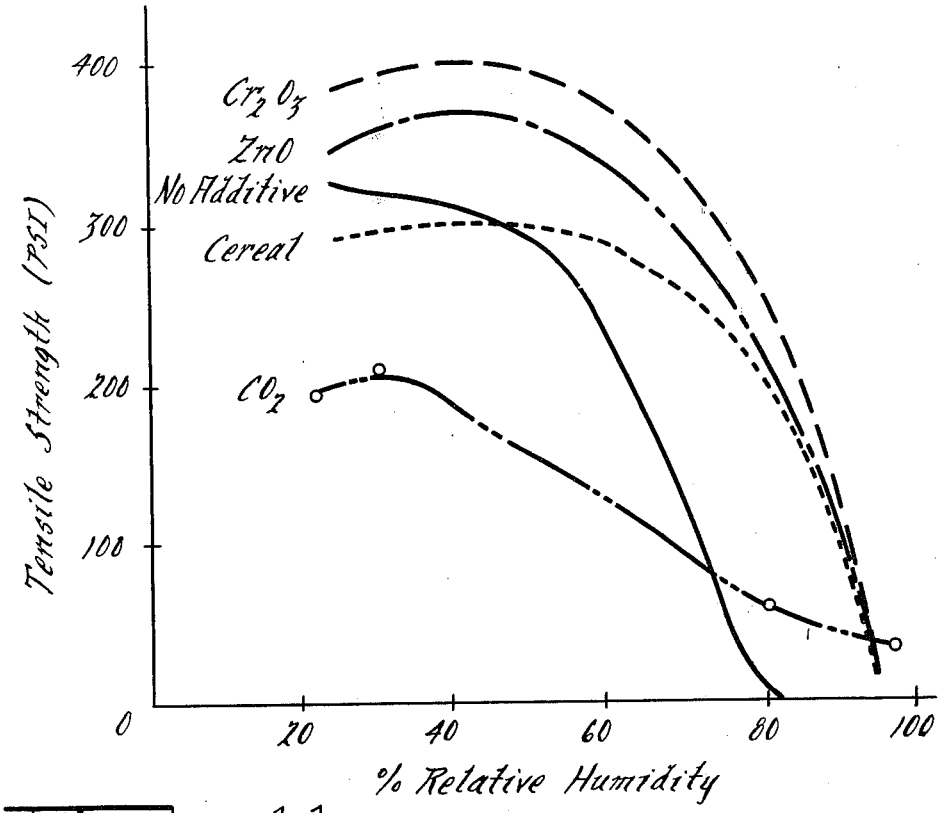
FIG. 11 is a graphical illustration of tensile strength versus percent relative humidity with different additives to the sand mixture.

The silicate absorbs moisture from the atmosphere, redissolves and loses its bonding capability, as shown in FIG. 11; a 2.0:1 ratio silicate was used as the primary binder material. Certain selected additives were able to significantly reduce the hygroscopicity even up to the 81% relative humidity level but none were able to impart any strength at 97% relative humidity. The most effective additives were zinc and chrome oxides (0.5% by weight), the least effective were the cupola slags (0.5%), sea coal (0.5%), $H_3PO_4$ (0.5%), and $Fe_3O_4$ (0.5%) the latter not shown in FIG. 11. Moderately effective was cereal (corn flour 0.5%), and $CO_2$ gas (blown for 2 seconds).

But most importantly the original strength of a core which has been exposed to high humidity can be completely recovered by subsequent microwave treatment and this was verified many times in the course of the investigation.

Shakeout

An important characteristic of a core is the ability to remove it after the casting has been made and this is referred to as its shakeout time. With aluminum, as opposed to iron, the casting temperature is so low (750° C. as opposed to 1450° C.) that most organic binders are not readily decomposed and shakeout is much more difficult. Sodium silicates on the other hand are difficult to remove from iron castings since the silica fuses with the soda at or near 815° C. However with aluminum this extra hardening reaction does not take place. Nevertheless, sodium silicates are strong and present a difficult problem for core removal.

Figure 12:
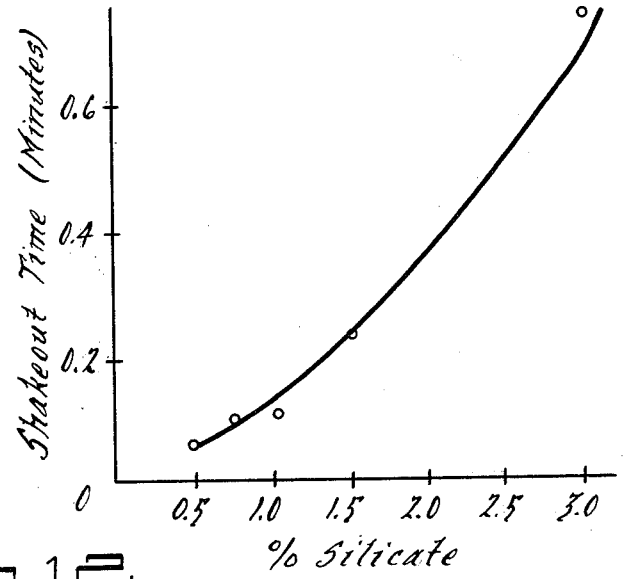
FIG. 12 is also a graphical illustration illustrating shake out time plotted against percent silicate, thereby illustrating the time required to decore aluminum casting as a function of silicate content.

In order to examine the shakeout problem a simulated permanent mold casting was designed whereby a section from a dogbone could be inserted to act as a core; shakeout of this essentially 25 mm cross section shape through a 10 mm hole was accomplished by vibrating the casting at a fixed amplitude, frequency, and impact energy until all of the sand had been removed. The effect of sodium silicate concentration on the time to remove a core is shown in FIG. 12. At the 0.5% silicate concentration, a shakeout time of 0.028 minutes was recorded: this value compares very favorably to the shakout time for the best organic core making system now in development by the foundry industry. While conventional $CO_2$-bonded silicate cores have been reported as being difficult to shakeout, the microwave-cured silicates were found to be much easier to remove since lower binder concentrations are utilized in accordance with this invention. Table II lists the shakeout time for different silicate formulations as well as providing comparison with other prior art binder systems. It can be seen that the unmodified silicates are rather difficult to remove; however with the zinc oxide or cereal, they are much better at shakeout when compared with the urethane system of similar tensile strength.

TABLE II

| Binder System | Sand Type | Additives | Binder % | Tensile Strength (psi) | Shakeout Time (SECS) |
|---|---|---|---|---|---|
| 1% Solid Silicate (2.0:1) | Wedron | None | 0.9 | 150 | >30* |
| | | | 1.8 | 255 | >30* |
| | | | 3.0 | 345 | >30* |
| | | 0.5% ZnO | 3.0 | 285 | 7.5 |
| | | 1% Cereal | 3.0 | 275 | 7.8 |
| | | 0.5% $Cr_2O_3$ | 3.0 | 335 | >30* |
| 1.25% Urethane (Prior Art) | Wedron | None | 0.5 | 50 | 3.8 |
| | | | 0.8 | 130 | 16 |
| | | | 1.0 | 155 | >30* |
| | | | 1.5 | 245 | >30* |
| | L.Mich. Sharp | None | 0.5 | 40 | 1.4 |
| | | | 0.8 | 80 | 2.2 |
| | | | 1.5 | 185 | 6.0 |
| | Arkansas Sharp | None | | | |
| 1.50% IDF-$SO_2$ (Prior Art) | Wedron | None | 1.25 | 80 | 2.8 |
| | | | 1.6 | 120 | 3.0 |
| | | | 2.5 | 250 | 4.8 |
| 4.5% Spirit (Prior Art) | Wedron | None | 4.5 | 230 | 4.1 |

*For shakeout times greater than 30 seconds, some solid segments of core always remained inside the casting.

Preferred Mode

A preferred mode for carrying out a rapid method of dehydrating a water-sand mixture, containing sodium and/or potassium silicate, to produce a strongly bonded sand mass, comprises:

1. Mixing silica sand, water and solid sodium and/or potassium silicate while maintaining the ratio of water to solid sodium or potassium silicate in the range of 1.45–3.22:1 and limiting the silicate addition to 0.25–3% by weight of said mixture.

2. Subjecting said mixture to microwave energy at a power level for a time period sufficient to generate a temperature level greater than 95° C. throughout said mixture for at least one minute whereby said mixture will be dehydrated. More optimumly, the silicate addition should be limited to 0.5–1% in order to achieve a shakeout time of considerably less than two seconds. To promote resistance to high relative humidity in excess of 52%, the power level of said microwave energy should be no less than 15 kw. min.

When making a disintegratable core, the preferred method would comprise:

1. Mixing silicate sand, soluble silicate and water with less than 1% of a water soluble organic binder resin.

2. Blowing said mixture into a core box having a predetermined cavity configuration, said core box being constituted of a material transparent to microwave energy except for a predetermined uniform distribution of glass or ceramic fibers effective to provide a predetermined degree of lossiness to microwave energy passing therethrough to heat the inner surface of the core box to a predetermined temperature, and 3. Exposing said core box containing said mixture to microwave energy effective to dehydrate said core and provide a core strength of at least 350 psi. It is most important to point out that the core box is made specifically to be only partially transparent to microwave energy. In so doing, heat thereby is generated within the core box itself, and the core box surface facing the core mixture can inpart heat to the outer surface of the core providing a more desirable strength gradient proceeding from the outer surface of the core inwardly.

I claim:

1. A rapid method for dehydrating a water/sand mixture containing sodium and/or potassium silicate to produce a strongly bonded sand mass, comprising:

(a) providing a mixture consisting essentially of silica sand, water and water soluble silicate while maintaining the ratio of water to silicate in the range of 1.45–2.50:1 and limiting the silicate addition to 0.25–1% by weight of said mixture;

(b) subjecting said mixture to microwave energy at a power level and for a time period sufficient to generate a temperature throughout said mixture for a time whereby said mixture will be dehydrated and bonded to a strength of at least 250 psi.

2. The method as in claim 1 in which said silicate is added in solid form.

3. The method of claim 1 in which said evaporation of moisture from said mixture during step (b) is limited to promote a supersaturated moist environment during heating.

4. The method as in claim 1, in which said silicate addition is limited to 0.25–1% whereby the resulting microwave cured sand mixture will have a shakeout time of less than 30 seconds when used as a core in a metal molding operation.

5. The method as in claim 1, in which said mixture is modified by the addition of one of the group consisting of zinc oxide and cereal in an amount effective to retain a strength level of at least 300 psi in an environment having a relative humidity in excess of 52%.

6. The method as in claim 1, in which the power level of said microwave energy is no less than 15 kw. min. whereby dehydration will be independent of time and power level when exposed to the microwave energy.

7. A method of making a sand core useful in casting metal;

(a) mixing essentially silica sand, water and less than 1% of a water soluble inorganic binder resin having a water/solid ratio of 1.45–2.5:1, said binder resin consisting of sodium silicate, potassium silicate or a mixture thereof;

(b) blowing said mixture into a core box having a predetermined cavity configuration, said core box being constituted of a material transparent to microwave energy except for a predetermined uniform distribution of glass or ceramic fibers effective to provide a predetermined degree of lossiness to microwave energy passing therethrough; and (c) exposing said core box containing said mixture to microwave energy effective to dehydrate said core and provide a core strength of at least 250 psi.

8. The method as in claim 7 in which said silicate is added in the solid form.

9. The method as in claim 7 in which the microwave energy is maintained at a level of at least 15 kw. min.

10. The method as in claim 7, in which said mixture additionally contains zinc oxide or chromic oxide whereby the dehydrated sand core will resist losing strength in an environment having a relative humidity in excess of 52%.

11. The resulting product from the practice of the method of claim 7, characterized by a strength of at least 345 psi after having been exposed to a relative humidity of about 52% for a period of at least one hour and a shakeout time of less than two minutes after having been used as a core in a casting operation.

12. A method of making a sand core useful in casting aluminum metal, comprising:

(a) mixing silica sand, water, and less than one percent of a water soluble, inorganic binder resin consisting of sodium silicate, the mixture having a silica/soda ratio of 2.0–3.22:1, said mixture also containing an additive of aminoaldehyde to provide a shakeout time of less than 30 seconds;

(b) blowing said mixture into a core box having a predetermined cavity configuration, said core box being constituted of a material transparent to microwave energy except for a predetermined, uniform distribution of glass or ceramic fibers effective to provide a predetermined degree of lossiness to microwave energy passing therethrough; and (c) exposing said core box containing said mixture to microwave energy effective to dehydrate said core and provide a core strength of at least 350 psi.

* * * * *